US005843362A

United States Patent [19]

Yoshii et al.

[11] Patent Number: 5,843,362

[45] Date of Patent: Dec. 1, 1998

[54] METHOD OF LABELING A CONTAINER WITH AN ELASTIC STRETCH LABEL

[75] Inventors: Toshiya Yoshii; Chihiro Wakatsuki; Hiroshi Harada, all of Osaka, Japan

[73] Assignee: Fuji Seal, Inc., Osaka, Japan

[21] Appl. No.: 649,154

[22] Filed: May 17, 1996

Related U.S. Application Data

[62] Division of Ser. No. 360,589, Dec. 21, 1994, abandoned.

[30] Foreign Application Priority Data

| | | | |
|---|---|---|---|
| Dec. 27, 1993 | [JP] | Japan | 5-333503 |
| Dec. 27, 1993 | [JP] | Japan | 5-333524 |
| Dec. 27, 1993 | [JP] | Japan | 5-333532 |
| Apr. 1, 1994 | [JP] | Japan | 6-065156 |
| Aug. 11, 1994 | [JP] | Japan | 6-189209 |
| Sep. 12, 1994 | [JP] | Japan | 6-217061 |

[51] Int. Cl.[6] ..... B65B 53/00

[52] U.S. Cl. ..... 264/342 R; 53/441; 156/86; 264/230

[58] Field of Search ..... 156/86, 287; 264/230, 264/210.1, 291, 342 R, 909; 53/441, 442, 48.2, 48.3; 100/9

[56] References Cited

U.S. PATENT DOCUMENTS

| | | | |
|---|---|---|---|
| 3,533,210 | 10/1970 | Peppler | 53/441 |
| 3,551,258 | 12/1970 | Galvanoni et al. | 156/287 |
| 4,196,240 | 4/1980 | Lustig et al. | 428/516 |
| 4,286,421 | 9/1981 | Fusio | 53/441 |
| 4,643,943 | 2/1987 | Schoenberg | 428/339 |
| 4,652,473 | 3/1987 | Han | 156/86 |
| 4,983,238 | 1/1991 | Yoshida et al. | 264/230 |

FOREIGN PATENT DOCUMENTS

| | | |
|---|---|---|
| 111244 | 6/1984 | European Pat. Off. . |
| 62-28226 | 2/1987 | Japan . |
| 556373 | 10/1943 | United Kingdom . |
| 1534292 | 11/1978 | United Kingdom . |

*Primary Examiner*—Richard Crispino
*Attorney, Agent, or Firm*—Jordan and Hamburg

[57] ABSTRACT

A stretch label adapted to be fitted to a container is manufactured and includes a stretch film, having a self-shrinking property, and a printing layer. The stretch film, in turn, includes a substrate made from an ethylene-vinyl acetate copolymer or a mixture of a low density polyethylene and an ethylene-vinyl acetate copolymer, and a surface layer made of a polyolefin resin. The surface layer is harder than the substrate and is provided on at least one surface of the substrate. The surface layer is the outer surface layer of the stretch label when the stretch label is fitted to the container.

1 Claim, 5 Drawing Sheets

METHOD OF LABELING A CONTAINER WITH AN ELASTIC STRETCH LABEL

This is a division of application Ser. No. 08/360,859, filed Dec. 21, 1994, now abandoned.

BACKGROUND OF THE INVENTION

This invention relates to a stretch label adapted to be applied to a container, especially a container having a circular cross-section, including a container in the form of a bottle made of plastic, such as a polyethylene terephthalate (PET) bottle, a glass bottle, a metal can, or the like.

A conventional stretch label of this type is made by forming a stretch film into a tubular shape by bonding both ends of the stretch film together via adhesive. The stretch film is made of a synthetic resin which possesses a self-shrinking property and has an excellent elastic shrinking property. An inner surface of the stretch film has a printing layer displaying an ornamental design, a trademark, etc. The stretch film, having a tubular shape, is radially expanded and fitted to a container, such as a PET bottle, for forming the stretch label.

In the event that the container with the conventional stretch label described above is accidentally impacted from the outside, such as during the transportation or packing process, the surface of the stretch label may be easily damaged. The reason the stretch label may be easily damaged is that the conventional stretch film is made of a single layer of a soft ethylene-vinyl acetate copolymer film positioned at the outermost surface of the conventional stretch label, such that the surface may be easily damaged. As a result, the appearance of the stretch label is deteriorated and the stretch label may even be torn.

Another problem with the conventional stretch label occurs when the container has to hold an item, such as food, beverage or a chemical product, which requires that the container be sterilized by spraying hot water at temperatures of 70° to 90° C. over its outer surface for 5 to 40 minutes. In this case, the conventional stretch label may be elongated due to the hot water, causing wrinkles and/or a slackening of a surface of the stretch label, such that there are gaps between the stretch label and the container.

In addition, when the conventional stretch label and the container are simultaneously expanded by the heat of the hot water, they are subsequently contracted by a cooling treatment. Since the expansion and contraction properties of the container are different from those of the stretch label, the initial heating and subsequent cooling of both results in a wrinkling or slackening of a surface of the stretch label, deteriorating the appearance of the conventional stretch label.

Furthermore, when hot water is sprayed on a container having a conventional stretch label thereon, upper and lower ends of the stretch label curve away from the container resulting in both upper and lower ends of the label being separated from the container. In addition, hot water may seep into any separated portion between the stretch label and the container, causing the stretch label to slip off the container.

Therefore, it is an object of the present invention to provide a stretch label, at least one surface of which possesses a scratch resistibility, while maintaining the appearance thereof without causing wrinkles and slackening, and slipping off of the stretch label from a container, when the stretch label is fitted to the container.

SUMMARY OF THE INVENTION

The present invention provides a stretch label adapted to be fitted to a container and includes a stretch film, having a self-shrinking property, and a printing layer. The stretch film, in turn, includes a substrate made from an ethylene-vinyl acetate copolymer or a mixture of a low density polyethylene and an ethylene-vinyl acetate copolymer, and a surface layer made of a polyolefin resin. The surface layer is harder than the substrate and is positioned on at least one surface of the substrate. The surface layer is the outer surface layer of the stretch label when the stretch label is fitted to the container. With this arrangement, it is unlikely that at least one surface of the stretch label is scratched from outside, as compared with a conventional stretch label which is only made from an ethylene-vinyl acetate copolymer. Strength of the stretch label can also be increased.

Further, the surface layer can be made from a low density linear polyethylene such that it can possess an excellent recoverability from an expanded state, and be relatively strong. As a result, it is unlikely that wrinkling, slackening and the like are formed on a surface of the stretch label.

Further, since the stretch label of the present invention is provided on an outer surface of the substrate which is made from an ethylene-vinyl acetate copolymer or a mixture of a low density polyethylene and an ethylene-vinyl acetate copolymer, each of which possesses an excellent elastic shrinking property, with the surface layer made from a propylene-ethylene random copolymer, it is unlikely that a surface of the stretch label will be scratched, as compared with a conventional stretch label, which is only made from an ethylene-vinyl acetate copolymer.

Furthermore, wrinkling and slackening of the stretch label, particularly in a lateral direction, during sterilization treatment, is prevented, since the stretch label contracts in a vertical direction, with respect to the container to which it is attached, which is a direction parallel to an axis of the container.

Additionally, wrinkling of the stretch label in a lateral direction can also be prevented when a shrinkage percentage of the stretch film is in the range of 1 to 15% in the vertical direction of the container, and is in the range of −0.5 to −5.0% in the circumferential direction of the container at 90° C. Since the stretch label is elongated in the range of 0.5 to 5.0% in the circumferential direction of the container during thermal expansion of the container, wrinkling of the stretch label, due to thermal expansion, can be avoided.

Preferably, the refractive index of the stretch label is in the range of 1.512 to 1.516 in the circumferential direction when fitted to the container, and is in the range of 1.513 to 1.520 in the vertical direction of the container, so that it is even more unlikely that wrinkling, slackening, etc. occur on a surface of the stretch label when heated, as compared with a conventional stretch label made of a polyethylene stretch film.

Preferably, an average surface roughness (Ra) of the stretch film on its innermost side contacting the container is in the range of 0.20 to 2.00 $\mu$m, so that even when the stretch film is expanded or contracted due to temperature changes the stretch label is equally expanded or contracted over substantially its entire area, which also serves to avoid wrinkles.

The stretch label can be made of a stretch film which possesses such a property that the stretch label is curved in a vertical direction thereof. When the stretch label is formed into a tubular shape, such that a concave surface of the stretch film faces inwardly when curved, and, for example, when sterilization treatment is applied to the stretch label which has been fitted to a container, a force acts on the stretch label in such a direction that upper and lower ends of the stretch label are curved towards the container. Thus, the stretch label is tightly fitted to the container substantially over its entire area, particularly at the upper and lower ends thereof. As a result, it is unlikely hot water will seep in between the stretch label and the container, such that the stretch label will not slip off the container during sterilization treatment.

The stretch label can be formed such that when it is heated to 70° C., it contracts in the circumferential direction of the container. As a result, the stretch label can be tightly fitted to the container, while avoiding slackening and the like, even when it is heated.

The stretch label can be made of a stretch film which has a heat shrinkage percentage of 1 to 10%, to improve its ability to contract in the circumferential direction of the container to which it is fitted. As a result, slackening of the stretch label can be avoided, improving its ability to be fitted to the container. In addition, when the heat shrinkage percentage of the stretch label is in the range of 1.5 to 5.0%, the stretch label can be even more properly fitted to the container, for more effectively preventing any slackening of the stretch label.

The above, and other objects, features and advantages of the present invention will become apparent from the detailed description thereof read in conjunction with the accompanying drawings.

DETAILED DESCRIPTION OF THE PREFERRED EMBODIMENTS

First Embodiment

Figure 1:
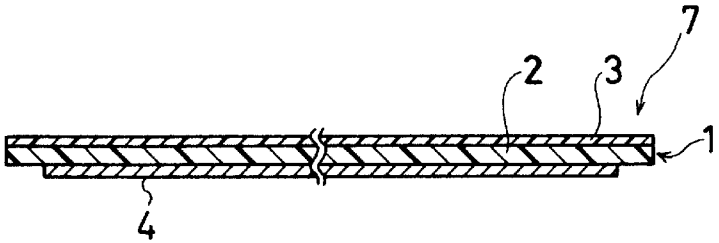
FIG. 1 is a cross section of a portion of a label body in accordance with one embodiment of the present invention.

Referring to FIG. 1, a stretch film 1 carries a substrate 2 made from an ethylene-vinyl acetate copolymer, and a surface layer 3 made from a low density linear polyethylene which is positioned on one side of the substrate 2. The vinyl acetate content in the ethylene-vinyl acetate copolymer which is used for the substrate 2 is preferably in the range of 1 to 10% by weight, and most preferably is in the range of 2 to 6% by weight. The substrate 2 possesses excellent elasticity and can easily be processed to make a label.

The substrate 2 may be made from a mixture of an ethylene-vinyl acetate copolymer, wherein a vinyl acetate content is preferably in the range of 2 to 6% by weight.

When the density of the low density linear polyethylene used for the surface layer 3 is in the range of 0.92 to 0.93 g/cm$^3$, it possesses an excellent recoverability from an expanded state, and is relatively strong, such that it is remarkably suitable as the surface layer 3 to be laminated to the substrate 2.

Further, various type of polyolefin resin can be used as the surface layer 3 provided that it is harder than the substrate 2. As a result, excellent mechanical strength can be obtained as determined for example, by Young's modulus. Examples of such a polyolefin resin include, but are not limited to, polyethylene, an ethylene-propylene copolymer, and the like.

Polyethylene may be used as the low density linear polyethylene, or the low and middle density polyethylene, a density of which being in the range of 0.92 to 0.94 g/cm$^3$, or it may be a mixed resin of these materials, or a mixture made by mixing an ethylene-vinyl acetate copolymer, an ethylene-propylene copolymer or the like, as a component, with the aforesaid mixed resin.

Further, when a resin, which is primarily made from an ethylene-propylene copolymer, is used as the surface layer 3, the stretch film possesses improved resistance. Preferably, the ethylene content in the ethylene-propylene copolymer used in this manner is in the range of 2 to 6% by weight. A polypropylene homopolymer, low density polyethylene, low density linear polyethylene, ethylene-vinyl acetate copolymer, petroleum resin or the like may be mixed to the propylene-ethylene random copolymer.

A heat stabilizer, antioxidant, lubricant or the like can be properly added to the resin used for the substrate 2 and the surface layer 3.

The above-described stretch film having a two-layer structure may be made by a co-extrusion method. The co-extrusion method involves separately melting an ethylene-vinyl acetate copolymer and a resin, used for the surface layer 3, in different extruding machines and bringing them to a die, then extruding them from the die to laminate the two extruded materials together. Each layer of the stretch film 1 made by this co-extrusion method is adhered to the other during their molten states, with the result that an inherent character of each layer can be maintained, enabling the stretch film 1 to be readily recovered from an expanded state.

Figure 3:
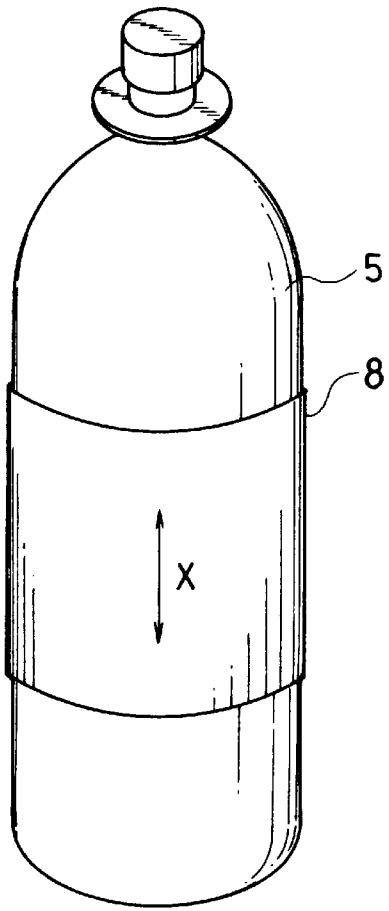
FIG. 3 is a perspective view illustrating the stretch label of the present invention fitted to a container.

During manufacturing of the stretch film 1, molecules thereof are slightly oriented in one direction, such that the stretch film 1 contracts in one direction when heated to more than 70° C. A stretch label 8 is formed from the stretch film 1, and a shrinking direction of the stretch film 1 is in the vertical direction X of a bottle 5, when fitted thereto, as illustrated in FIG. 3.

The degree of molecular orientation applied to the stretch film 1 is such that a heat-shrinkage percentage is preferably in the range of 1 to 15% at 90° C. The tension force applied to the stretch film 1 extruded from the die can be adjusted to properly and slightly apply molecular orientation to the stretch film 1.

A printing layer 4 is provided on the side of the substrate 2 opposite the surface layer 3. A product's name, ornamental designs and the like are printed on the printing layer 4 by gravure or another conventional printing process. Preferably, the surface layer 3 makes up 1 to 30%, and more preferably 2 to 10%, of the thickness of label body 7. The thickness of the label body 7 is preferably in the range of 10 to 150 μm. Thus, for example, when the surface layer 3 has a thickness of 3 μm, the substrate 2 has a thickness of 37 μm, the total thickness being 40 μm. Additionally, when the surface layer 3 has a thickness of 5 μm, the substrate 2 has a thickness of 55 μm, the total thickness being 60 μm. Thus, the thickness of the label body 7 may preferably be varied within the range referred to above.

Figure 2:
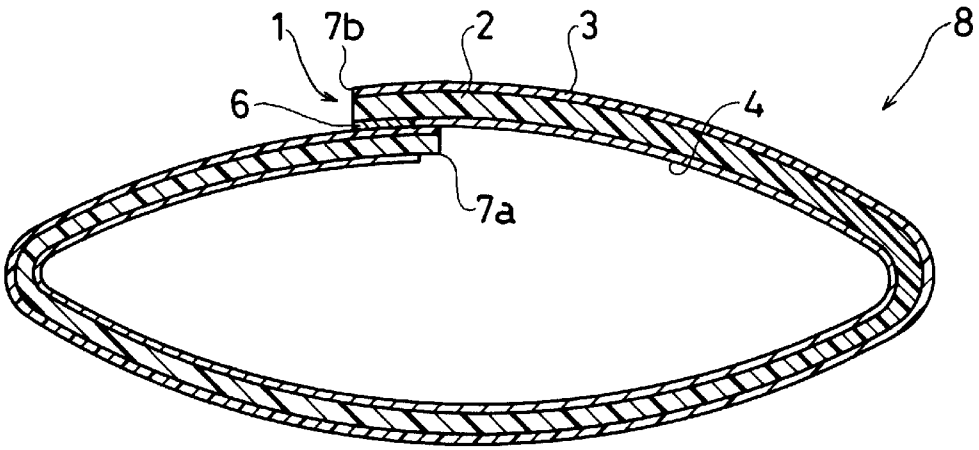
FIG. 2 is a cross section of a stretch label of the present invention.

Referring to FIG. 2, the label body 7 is formed into a tubular shape, such that the printing layer 4 faces inwardly. Edges 7*a* and 7*a b* of the label body 7 can be bonded together by an adhesive 6 to form a stretch label 8.

Referring to FIG. 3, the stretch label 8 is radially expanded and fitted to the PET bottle 5 from above. Then, the diameter of the stretch label 8, which was once enlarged is reduced to its original size, such that the stretch label 8 is tightly fitted to the PET bottle 5. In this regard, since the stretch label 8 has a structure in which the surface layer 3 is provided on the outer side of the substrate 2 made from an ethylene-vinyl acetate copolymer, the stretch label 8 has an excellent elongation property for allowing radial expansion, and an excellent recoverability of its original diameter after being fitted to the PET bottle 5.

After the stretch label 8 is fitted to the container, for example, the PET bottle 5, a beverage, such as soda, is poured into the PET bottle 5. Then, the PET bottle 5 is subjected to sterilization treatment by spraying hot water of 70° to 90° C. over the PET bottle 5 for 5 to 40 minutes to heat sterilize its contents. Since the stretch film 1 of the stretch label 8 is able to vertically contract in direction X with regard to the PET bottle 5, when heated, the appearance of the stretch label 8 can be maintained without causing wrinkles or the like which frequently occur in a conventional label during sterilization treatment.

In the event that the PET bottle 5 with the stretch label 8 thereon happens to bang against adjacent bottles, or the like, when filling the bottle, packing it, or transporting it for display and the like, such impact is unlikely to create scratches on the stretch label 8, since the surface layer 3 is provided on the outermost surface of the stretch label 8, as compared with a conventional stretch label, which is only made from an ethylene-vinyl acetate copolymer.

In the above embodiment, the stretch film 1 is able to vertically contract in direction X at a temperature applied for sterilization treatment. However, it is not essential that the stretch film 1 possesses such a property.

When the thickness of the surface layer 3 is in the range of 1 to 30% of the overall thickness of the label body 7, a preferable elongation property is obtainable. However, it is not essential to limit the thickness of the surface layer 3 within such a range. The surface layer 3 may be provided on the inner side of the stretch label 8 as well as on the outer side thereof to form a three-layer film.

It is not essential to limit a printing method on the printing layer 4 to gravure, described in the above embodiment. Any type of printing method may be used to form the printing layer 4, provided that it can print the required information on the film made in accordance with the present invention.

In the above embodiment, the printing layer 4 is provided on an entire area of the inner side of the stretch film 1. However, the printing layer 4 may be provided on a partial region of the stretch film 1. In addition, the printing layer 4 may be provided on an outer side of the surface layer 3, and a transparent coating may be applied on an outer surface of the printing layer 4 to protect the printing layer 4.

Further, it is not necessary to limit a method for making the film to the co-extrusion method. Other conventional methods such as a dry laminate method, which comprises steps of respectively making a plurality of layers and bonding them together, or an extrusion laminate method, which comprises steps of melting a resin used for the surface layer 3 and extruding the molten resin onto a surface of the substrate 2 may be employed in the present invention.

Further, it is not necessary to limit a container to the PET bottle 5. A bottle, can or the like made of a variety of materials may be used as an object to which the stretch label 8 is applied. In addition, the contents of the container may be varied, for example, food products, beverages, drugs, etc. may be placed in the container.

Further, the advantages of the stretch label of the present invention are not limited to its ability to maintain its appearance during and after sterilization treatment, since the stretch label also avoids wrinkles or the like when the container, to which the label is fitted, is stored at high temperatures.

Second Embodiment

Figure 4:
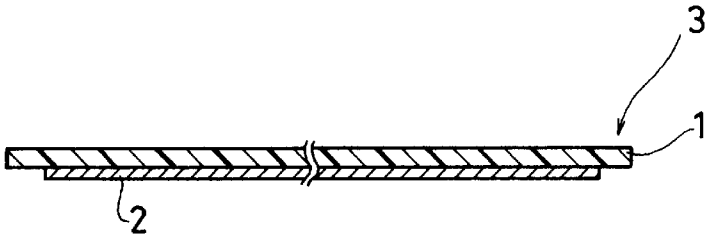
FIG. 4 is a cross section of a portion of a label body in accordance with another embodiment of the present invention.

Referring to FIG. 4, a stretch film 1 is made from an ethylene-vinyl acetate copolymer, a vinyl acetate content of which is preferably in the range of 1 to 6% by weight. A printing layer 2 is provided on either side of the stretch film 1 to display a product's name, ornamental designs and the like by gravure, or other conventional printing methods.

The stretch film 1 is made of a film which contracts in one direction when subjected to sterilization treatment. A shrinkage percentage of the stretch film 1 is preferably in the range of 1 to 15% and more preferably is in the range of 3 to 12% at 90° C. to best avoid wrinkling, slackening, deformation, etc.

A further advantage can be obtained when the stretch film 1 is elongated in a direction, perpendicular to the above mentioned direction, in the range of 0.5 to 5.0%, and more preferably 1.0 to 4.0%. A shrinkage percentage is determined by soaking the stretch film 1 in hot water having a temperature of 90° C. for 10 minutes, and observing changes in the size of the stretch film 1.

A method for manufacturing the stretch film having the above property will be described hereinafter.

An ethylene-vinyl acetate copolymer is melted and brought to a temperature of 180° to 220° C. and extruded from a T-die in the form of a continuous film. The continuous film is wound around a cooling drum to cool and solidify the extruded film. A draft is applied to the film in the range of 5 to 20 between the T-die and the cooling drum such that a molecular orientation is slightly applied to the film in a longitudinal direction thereof. Then, the film is transported from the cooling drum to a heating roller of 60° to 100° C. for a slight degree of heating treatment; as a result, the molecules of the film are not oriented in a lateral direction of the film. The film is subjected to corona discharge treatment or other conventional treatment to facilitate printing on a surface of the film.

Figure 6A:
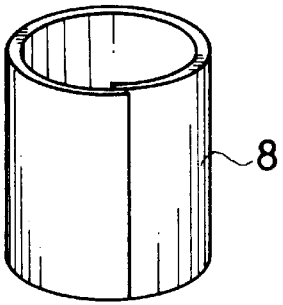
FIG. 6A is a perspective view of the stretch label.
Figure 6B:
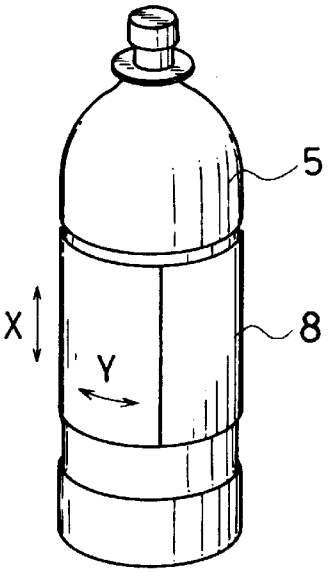
FIG. 6B is a perspective view of the stretch label of FIG. 6A fitted to a container.
Figure 5:
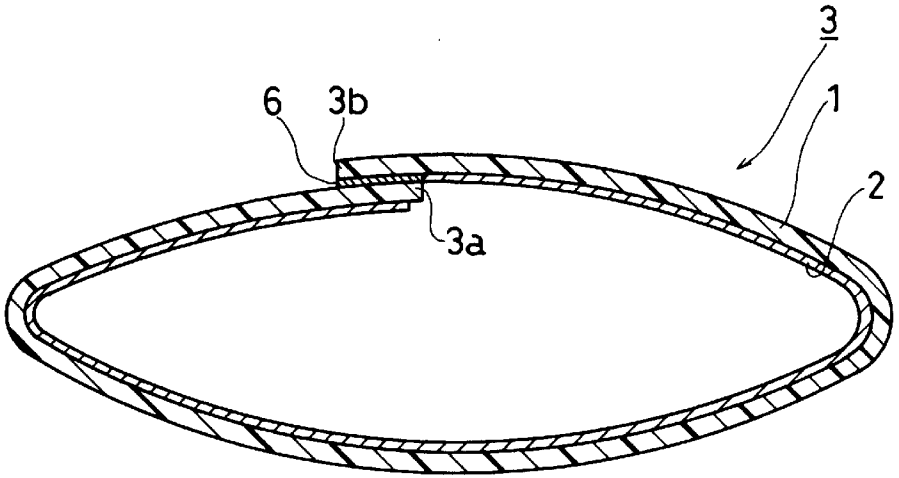
FIG. 5 is a cross section of the stretch label of FIG. 4.

Referring to FIG. 5, a label body 3 carrying the stretch film 1 and the printing layer 2 is formed into a tubular shape such that the printing layer 2 faces inwardly. Edges 3*a* and 3*b* of the label body 3 can be bonded together by an adhesive 6 to form the stretch label 8. The stretch label 8 is formed such that when fitted to a container, such as a PET bottle 5, the stretch label 8 vertically contracts in direction X with regard to the container, as illustrated in FIG. 6B. The stretch label 8 is radially expanded, and fitted to the PET bottle 5 from above, as illustrated in FIGS. 6A and 6B.

Then, the PET bottle 5 with the stretch label 8 thereon is filled, for example, with soda, and is subjected to sterilization treatment in the same manner as in the first embodiment.

In this state, the stretch film 1 vertically contracts in direction X of the PET bottle, while slightly expanding in a circumferential direction Y thereof, thus avoiding wrinkling and slackening of the label 4.

Although, a vinyl acetate content in the ethylene-vinyl acetate copolymer of the stretch film 1 is preferably 1 to 6%, it is not necessary to limit the vinyl acetate content to such a range.

The stretch film 1, which is made from an ethylene-vinyl acetate copolymer alone, is used in this embodiment. However, the film may be made by a co-extrusion method using various materials such as a low density polyethylene, low density linear polyethylene, ionomer, ethylene-acrylic acid copolymer, ethylene-propylene copolymer or the like, or a mixture of these materials or the film may be made in the form of a multi layer film made by laminating these materials together.

Amorphous polyolefin resin, which possesses an excellent shrinking property, but is difficult to use as a monolayer film, may be used as an intermediate layer, if a multi layer film made of more than three layers is employed. Amorphous polyolefin has an extracted insoluble matter of less than 70% by weight, more preferably less than 60% by weight, when extracted by a Soxhlet extractor, using boiling n-heptane. In particular, amorphous polyolefin resin with a propylene content of more than 50% by weight is preferable. For example, amorphous polyolefin resin may be made by equally kneading 60% by weight of propylene butene-1 copolymer with a butene-1 content of 35% by weight having an amorphous property, and 40% by weight of crystalline polypropylene with a melt flow rate of 1.5 g/10 minutes at 230° C. That is, a film of varying type may be used provided that molecular orientation is slightly applied to the film to render a heat shrinking property thereto, as described above, Third Embodiment Referring to FIGS. 7A and 7B, a label body 1 includes a stretch film 2, a printing layer 3, and a white printing layer 4, which is provided on an outer surface of the printing layer 3. The stretch film 2 is first subjected to corona discharge treatment on the side to which the printing layer will be applied. The printing layer 3 can be, used to display a product's name, ornamental designs, etc. by being subjected to gravure or another printing process. An outer surface of the white printing layer 4 is preferably of an average surface roughness (Ra) of 0.20 to 2.00 $\mu$m, which is determined by the JIS (Japanese Industrial Standard) B0601 testing method.

Figure 8:
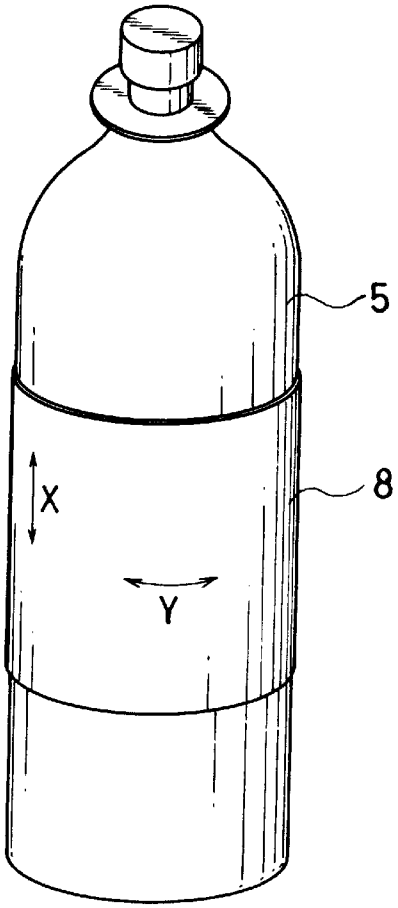
FIG. 8 is a perspective view illustrating the stretch label fitted on a container.

The label body 1 is formed into a tubular shape such that the white printing layer 4 faces inwardly. A stretch label 8 made from the label body 1 is radially expanded and fitted to a container, such as a PET bottle 5, from above, as illustrated in FIG. 8.

The stretch film 2 is made from a mixture of an ethylene-vinyl acetate copolymer and a low density polyethylene, a refractive index of which is preferably in the range of 1.512 to 1.516 in a circumferential direction Y of the PET bottle 5, and is preferably in the range of 1.513 to 1.520 in a vertical direction X when the stretch film 2 is fitted on the PET bottle 5. The refractive index is determined by the JIS K7105 testing method. When the refractive index of the stretch film 2 is within the ranges, referred to above it is less likely the stretch label 8 will wrinkle, separate from the PET bottle 5, or slip off the PET bottle 5.

A method for manufacturing the stretch label 8 of the above arrangement will be described hereinafter.

An ethylene-vinyl acetate copolymer with a vinyl acetate content of 6% by weight (melt index (MI) 1.5 g/10 minutes), and a low density polyethylene (melt index (MI) 1.8 g/10 minutes), the ratio of the ethylene-vinyl acetate copolymer to the low density polyethylene being 50 to 50 by weight, are equally mixed together, supplied to an extrusion machine, melted and extruded therefrom at 200° C., and wound around a cooling drum 7, a surface of which is set at 25° C., to be cooled and solidified, to form a film sheet having a thickness of 110$\mu$. A draft ratio which means a ratio of a speed of a resin when extruded from a die of an extrusion machine to a winding speed of the cooling drum was varied in the range of 3 to 15 in this embodiment.

Then, the film sheet is heated to more than 50° C., but less than 70° C. with a heating roller, drawn in the longitudinal direction thereof in the range of 1.0 to 1.3 times with a draw roller, and subsequently wound around a cooling roller, a surface temperature of which is set at 25° C., to be cooled. Then, this film sheet is transported to a tenter to be drawn in the lateral direction thereof, while being heated to 60° to 90° C. Subsequently, the film sheet is subjected to heat treatment under relaxed or tensed condition with hot air of 70° to 90° C., and gradually cooled down to room temperature. It is possible to obtain a film sheet having a varying refractive index by varying the draft rate, drawing magnification in both directions, drawing temperature, or by varying a condition for heat treatment within the above-defined range.

One surface of the film is subjected to corona discharge treatment to form a printing layer 3, on which product's names, ornamental designs or the like are printed. The printing layer 3 is, in turn, covered with a white print to form a white printing layer 4. An average surface roughness (Ra) of one surface of the film can be varied in the range of 0.20 to 2.00 $\mu$m by varying a particle size of a pigment, such as titanium oxide, in the ink for making the white printing layer 4.

Figure 7A:
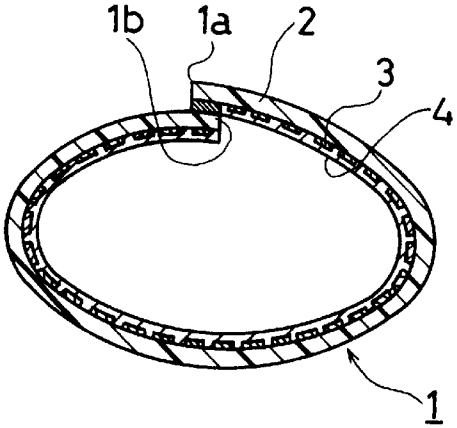
FIG. 7A is a cross section of the stretch label of a further embodiment.
Figure 7B:
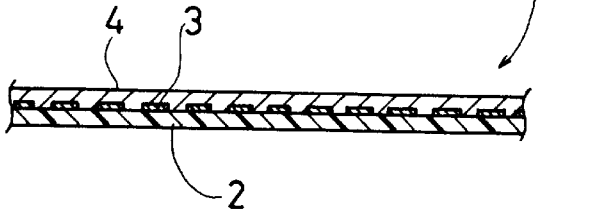
FIG. 7B is an enlarged cross section of a portion of the cross section of FIG. 7A.

Then, the film is formed into a tubular shape by bonding edges 1*a* and 1*b* together using adhesive, or the like, such that a surface, on which the white print is provided, faces inwardly, as illustrated in FIG. 7A. The stretch label 8 is radially expanded, and fitted to the PET bottle 5 from above, as illustrated in FIG. 8. At this stage, the stretch label 8 is formed such that a lateral direction thereof becomes consistent with a circumferential direction Y, and a longitudinal direction thereof becomes consistent with the vertical direction X when the stretch label 8 is fitted to the PET bottle 5.

Testing was conducted in order to determine a quality of the stretch film by using stretch films having different refractive indexes, which are fitted to containers and subjected to sterilization treatment. The stretch films of varying refractive indexes are prepared by varying the draft rate, the drawing magnification in both directions of the film and other manufacturing conditions. The resultant evaluation of appearances of the stretch films having different refractive indexes are shown in Table 1.

TABLE 1

| Film Sample | Refractive Index longitudinal direction (Y) | Refractive Index lateral direction (X) | Average Surface Roughness Ra (μm) | Evaluation of Appearance Wrinkling | Evaluation of Appearance Slackening | Remarks |
|---|---|---|---|---|---|---|
| Film A | 1.516 | 1.514 | 1.20 | ○ | ○ | acceptable |
| Film B | 1.520 | 1.514 | 1.20 | Δ | ○ | acceptable |
| Film C | 1.513 | 1.514 | 1.20 | Δ | ○ | acceptable |
| Film D | 1.515 | 1.516 | 1.20 | ○ | Δ | acceptable |
| Film E | 1.515 | 1.512 | 1.20 | ○ | Δ | acceptable |
| Film F | 1.509 | 1.508 | 1.20 | × | × | unacceptable |
| Film G | 1.516 | 1.514 | 0.15 | Δ to × | ○ | |
| Film H | 1.516 | 1.514 | 2.60 | ○ | Δ to × | |

The stretch labels A to H, each of which having a different refractive index, were prepared, in which the films A to E each have a refractive index and average surface roughness (Ra) in the ranges defined by the present invention.

The stretch labels F to H were prepared as comparative examples, in which the stretch label F is of a lower refractive index in both directions than that of the present invention.

The refractive of the stretch label H is within the ranges defined by the present invention, but its average surface roughness is out of the range of 0.20 to 2.00 μm, which is defined by the present invention.

The refractive index was measured by Abbe's refractometer in accordance with the JIS (Japanese Industrial Standard) K7105 testing method. Average Surface Roughness Ra, was measured in accordance with the JIS (Japanese Industrial Standard) B0601 testing method, wherein the cutoff is set at 0.80 m/m.

The above eight samples of the stretch label were respectively fitted to PET bottles were subsequently filled with soda. Then, the PET bottles were sprayed with hot water of 70° C. for 40 minutes for sterilization treatment, and cooled down. Then, the appearance of the stretch labels were evaluated via visual observation. In the above Table 1, the symbols used define the following.

(○) An appearance of the film was maintained without any marked wrinkling or slackening.

(Δ) An appearance of the film was slightly deteriorated by marked wrinkling or slackening.

(X) An appearance of the film was deteriorated by marked wrinkling or slackening.

As is apparent from Table 1, the refractive index and average surface roughness of the stretch labels A to E are within the range defined by the present invention. As a result, stretch labels A to E are unlikely to wrinkle or slacken and can maintain their appearance, even when sprayed with hot water.

In this embodiment, to adjust surface roughness of the innermost surface of the stretch label to the above range, the white printing layer 4 is provided on an entire area of the inner surface of the stretch label, and a particle size of a pigment, such as silica, titanium oxide, or the like, in the printing ink of the white color printing layer 4 is adjusted. However, it is not essential to limit a method for adjusting surface roughness to this embodiment. Other methods, which include coating a material on a surface of the stretch label to roughen the surface, may be employed.

Fourth Embodiment

Referring to FIGS. 4 and 5, the stretch film 1 is made from an ethylene-vinyl acetate copolymer having a vinyl acetate content of 1 to 6% by weight, an inner side of which being provided with a printing ink layer 2. A label body 3, including the stretch film 1 and the printing ink layer 2, is formed into a tubular shape by bonding both edges thereof via an adhesive or other bonding means such as heat sealing.

When a vinyl acetate content of the ethylene-vinyl acetate copolymer of the shrinking film 1 is lower than the above range, its self shrinking ability may be decreased. On the contrary, when the amount of vinyl acetate is higher than the above range, the stretch film 1 may be excessibly softened, such that printing or labels cannot be readily applied thereto.

The stretch film 1 has such a property that when it is heated to more than 70° C., but less than 90° C., it is slightly curved in the vertical direction X with regard to the container 5. The stretch film 1 having such a property is formed into a tubular shape such that when it is curved, a concave surface thereof faces inwardly. Further, the stretch film 1 has such a property that when it is heated to more than 70 ° C., but less than 90° C., it slightly contracts in the vertical direction X with regard to the container 5 at the same time as it is curved in the same direction.

In addition, one surface of the stretch film 1 is previously subjected to corona discharge treatment, and the printing layer 2 is provided by gravure or similar process on the surface of the stretch film 1 which has been previously subjected to corona discharge treatment.

A method for manufacturing the stretch label having the label body 3 of the above structure will be described hereinbelow.

Figure 9:
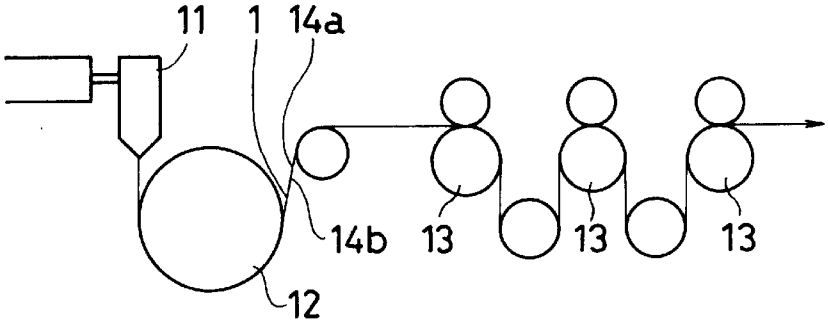
FIG. 9 is a diagramatical view illustrating steps for manufacturing the stretch film.

Referring to FIG. 9, an ethylene-vinyl acetate copolymer with a vinyl acetate content of 1 to 6% by weight is melted and brought to a temperature of 180° to 220° C. and extruded from a T-die 11 in the form of a thin film, and then wound around the cooling drum 12 for cooling and solidification thereof to form the stretch film 1.

Then, the stretch film 1 is slightly drawn in the longitudinal direction by the roll 13, thus rendering a heat shrinking property in the same direction to the film 1. The heat shrinking property is of such a degree that the film 1 will contract in the range of 1 to 10% when heated to more than 70° C., but less than 90° C.

Then, this stretch film 1 is transported in a forward direction, while the surface **14*b* thereof, which is opposite to a surface 14*a* tightly contacting the cooling drum 12, is subjected to corona discharge treatment. The printing layer 2 is then provided as the surface 14*b* of the stretch film 1 for displaying a product's name, ornamental design or the like by gravure or other conventional printing methods. Then, the stretch film 1** is cut into pieces, each having a predetermined width.

Figure 11A:
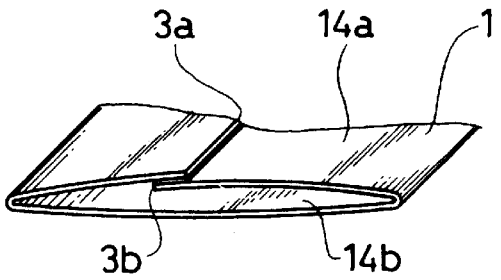
FIG. 11A is a perspective view illustrating the stretch film formed into a tubular shape.
Figure 11B:
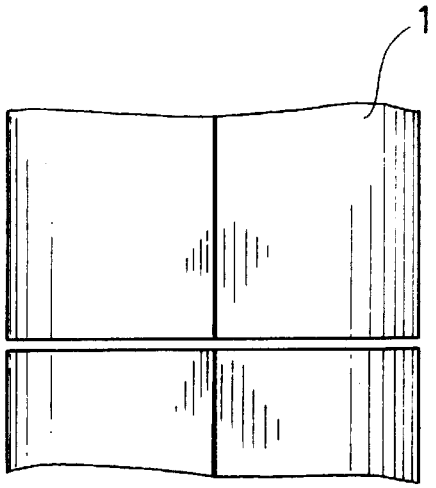
FIG. 11B is a front view illustrating the stretch film cut into pieces.
Figure 10:
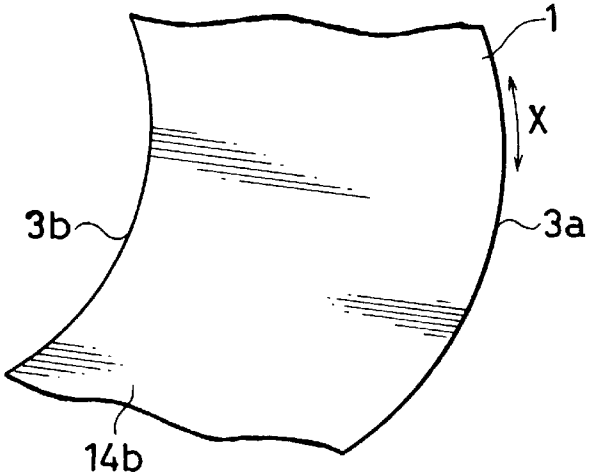
FIG. 10 is a perspective view illustrating the stretch film of the present invention when it has been heated.
Figure 12:
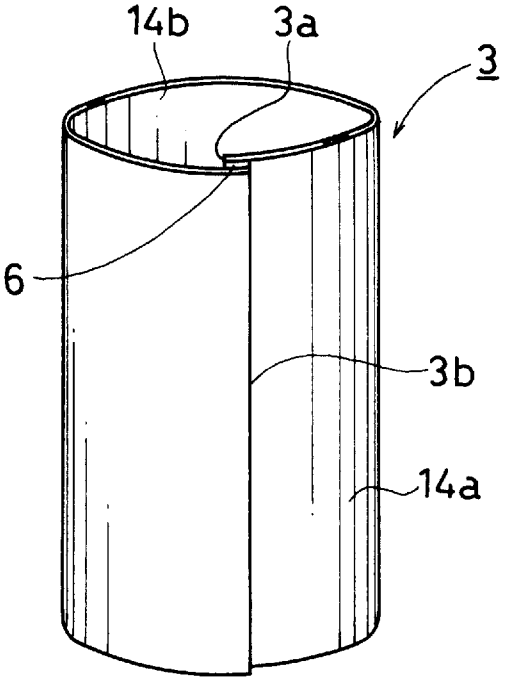
FIG. 12 is a perspective view of the stretch film formed into a tubular shape to form the stretch label.

The stretch film 1 made in the above manner has such a property that when it is heated to more than 70° C., but less than 90° C., the surface **14*b* is curved in the longitudinal direction X thereof in such a manner as to be concave, as illustrated in FIG. 10. Referring to FIGS. 11A and 11B, the stretch film 1 having such a property is formed into a tubular shape by bonding edges 3***a* and 3*b* thereof via an adhesive 6 such that the surface 14*b* faces inwardly. Then, the tubular shaped stretch film 1 is cut into pieces, each having a predetermined length, to form the label body 3, as illustrated in FIG. 12.

A method for manufacturing the stretch label of the above arrangement will be described hereinafter.

Figure 13:
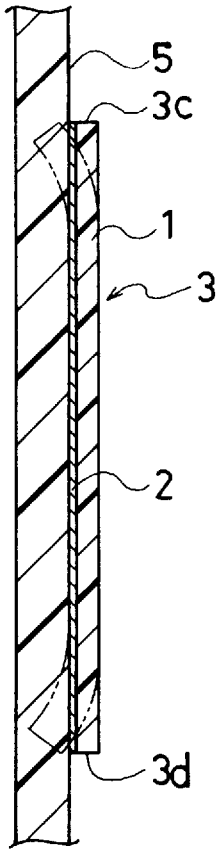
FIG. 13 is an enlarged cross section of a portion of a stretch label of the further embodiment fitted to a container.

The label body 3 of a tubular shape is radially expanded, and fitted to the PET bottle 5 from above. The PET bottle 5, with the stretch label 8 thereon, is filled with soda or the like, and subsequently subjected to sterilization treatment, during which a body portion of the PET bottle is circumferentially expanded by heat. Since an upper edge 3*c* and lower edge 3*d* of the label body 3 is curved towards the PET bottle 5 as illustrated by phantom lines in FIG. 13, these edges can tightly contact the PET bottle 5 without any clearance therebetween, such that the stretch label 8 tightly contacts the PET bottle 5 at its whole contacting area. Accordingly, it is unlikely that hot water sprayed during sterilization treatment will seep in between the stretch label 8 and the PET bottle 5, thus avoiding the slipping off of the stretch label 8 from the PET bottle 5.

In addition, since the stretch film 1 has such a property that, when heated, it slightly contracts in the vertical direction X with regard to the PET bottle 5, laterally extending wrinkles with regard to the PET bottle 5 can effectively be avoided in cooperation with the curving of the film 1.

In this embodiment, the stretch film 1, which has been previously cooled down and solidified, is subjected to drawing treatment to render a heat shrinking property thereto. However, drawing treatment can be omitted in the present invention, and the stretch film without a heat shrinking property can be used.

Figure 14:
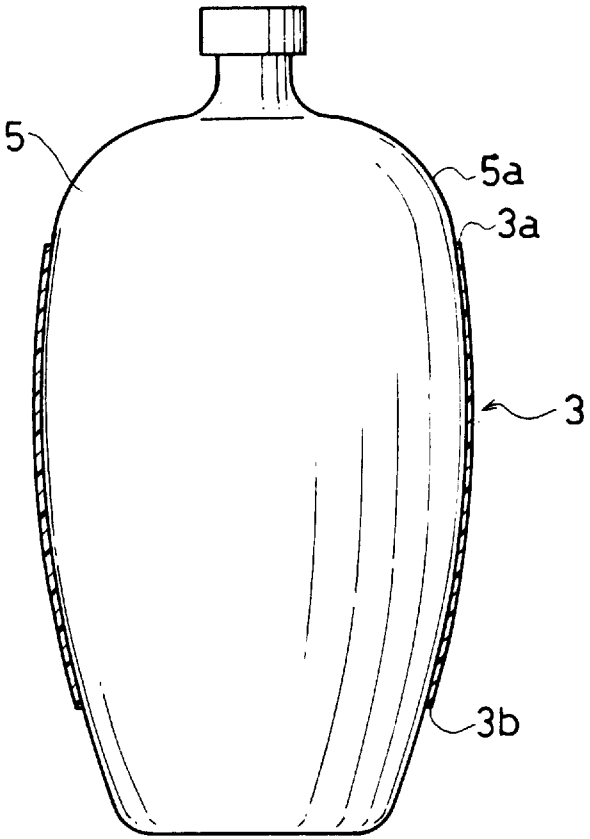
FIG. 14 is a diagrammatic partial cutaway side elevational view of the stretch label of the present invention fitted to a container.

The PET bottle 5 having a uniformly shaped body portion is employed as a container in this embodiment, but a container having a slightly curved surface 5*a*, shown in FIG. 14, may be used. When the stretch film 1 is fitted to the curved surface 5*a*, the label body 3 including the upper and lower edges 3*a* and 3*b* can tightly contact the PET bottle 5, since a force is applied to the stretch film 1 in such a direction that the stretch film 1 is curved towards the PET bottle 5.

Further, the stretch film 1 is made from an ethylene-vinyl acetate copolymer in this embodiment. However, the stretch film 1 may be made from a mixture of 50% of an ethylene-vinyl acetate copolymer with a vinyl acetate content of 6% by weight and 50% of a low density polyethylene. Alternatively, the stretch film 1 may be made from a low density linear polyethylene, propylene-ethylene random copolymer or the like. Further, the stretch film 1 may be made in the form of a multilayer film made by laminating these materials together, in which an amorphous polyolefin may be an intermediate layer. That is, it is essential that a stretch film is curved in the vertical direction of the label body 3, when heated to more than 70° C., but less than 90° C., as in the second embodiment.

Fifth Embodiment

Referring to FIGS. 4 and 5, the stretch film 1 is made of a single layer film on the order of 30 to 100 $\mu$m which is made from an ethylene-vinyl acetate copolymer. The label body 3 is made of the stretch film 1 and the printing layer 2 is provided on one surface of the stretch film 1.

The stretch film 1 has such a property that it slightly contracts in the circumferential direction of the label body 3, when subjected to sterilization treatment, the shrinkage percentage of the film being preferably in the range of 1 to 10% at 70° C. When the shrinking percentage is less than 1%, the shrinking film 1 is not shrinked so tight as to be securely positioned on the PET bottle during sterilization treatment with the result that the label body 3 may readily slip off the container. On the contrary, when the shrinking percentage is more than 10%, the shrinking property is deteriorated, and, therefore, the label does not tightly contact the container. In view of these facts, it is more preferable that the shrinking percentage of the stretch film 1 is in the range of 1.5 to 5.0% at 70° C.

A method for manufacturing the stretch film 1 having such a property will be described below.

Molten ethylene-vinyl acetate copolymer at a temperature of 180° to 220° C. is extruded from a T-die in the form of a continuous film, and wound around a cooling drum to cool and solidify the extruded film. The continuous film is then drawn in the lateral direction thereof by 1.05 to 2.0 times, and subjected to heat treatment. Thus, the stretch film 1 having the above defined shrinking percentage in the lateral direction thereof is manufactured.

The label body 3 is formed such that the drawing direction of the stretch film 1 becomes consistent with the circumferential direction Y when fitted to a container, such as the PET bottle 5. The stretch film 1 is subjected to corona discharge treatment or one surface to facilitate the application of a printing ink thereto. On the side of the stretch film 1 subjected to corona discharge treatment is provided a printing layer 2 for printing a product's name, ornamental designs and the like by gravure or other conventional printing methods.

Then, the label body 3, including the stretch film 1 and the printing layer 2, is formed into a tubular shape such that the printing layer 2 faces inwardly. Then, both edges 3*a* and 3*b* of the label body 3 are bonded together via the adhesive 6, as illustrated in FIG. 5.

The label body 3, having a predetermined length, is radially expanded and fitted to the PET bottle 5 from above, as illustrated in FIG. 6B. The PET bottle 5, with the label body 3 thereon, is then filled with soda or the like, and subjected to sterilization treatment in the same manner as the above embodiments.

Since the stretch film 1 contracts in the circumferential direction Y of the PET bottle 5 when heated, it is unlikely that the stretch film 1 is undesirably elongated in the same direction by the heat of the hot water sprayed during sterilization treatment.

In this embodiment, the stretch film 1 is formed of a single layer film which is made from an ethylene-vinyl acetate copolymer. However, the stretch film 1 may be formed of a single layer film which is made from a low density polyethylene, or a mixture of an ethylene-vinyl acetate copolymer and a low density polyethylene. Alternatively, the stretch film 1 may be made in the form of a multilayer film with a polypropylene resin layer on its front surface. That is, it is essential that a stretch film possesses self-shrinking and heat-shrinking properties as described in the aforementioned embodiments.

This specification is by no means intended to restrict the present invention to the preferred embodiments set forth therein. Various modifications to the stretch label of the present invention, as described herein, may be made by those skilled in the art without departing from the spirit and scope of the present invention as defined in the appended claims.

What is claimed is:

1. A method of labeling a container comprising radially expanding a stretch label comprising an elastic stretch film formed into a tube having an elastic recovering force from an expanded state thereof, the stretch film being made of an ethylene-vinyl acetate copolymer with an amount of vinyl acetate in the range of 1 to 6% by weight and polyethylene, and a refractive index of the stretch film being in the range of 1.513 to 1.520 in a direction parallel to an axis of the container, and in the range of 1.512 to 1.516 in a circumferential direction of the container;

applying said radially expanded stretch label over a container; and bringing said stretch label into a tight contact with said container via said elastic recovering force of said stretch film.

* * * * *